US008242982B2

(12) United States Patent
Kang et al.

(10) Patent No.: US 8,242,982 B2
(45) Date of Patent: Aug. 14, 2012

(54) FEEDBACK CONTROL OF LIGHTING-EMITTING BLOCKS IN A DISPLAY APPARATUS

(75) Inventors: Eui-Jeong Kang, Chungcheongnam-do (KR); Gi-Cherl Kim, Gyeonggi-do (KR); Byung-Choon Yang, Seoul (KR); Byoung-Dae Ye, Gyeonggi-do (KR); Dong-Min Yeo, Daegu (KR)

(73) Assignee: Samsung Electronics Co., Ltd. (KR)

( * ) Notice: Subject to any disclaimer, the term of this patent is extended or adjusted under 35 U.S.C. 154(b) by 639 days.

(21) Appl. No.: 12/407,448

(22) Filed: Mar. 19, 2009

(65) Prior Publication Data

US 2009/0295309 A1 Dec. 3, 2009

(30) Foreign Application Priority Data

Jun. 2, 2008 (KR) ..... 2008-51810

(51) Int. Cl.
*G09G 3/30* (2006.01)

(52) U.S. Cl. ..... 345/76; 345/83; 345/204

(58) Field of Classification Search ..... 345/76–84, 345/98, 102, 204
See application file for complete search history.

(56) References Cited

U.S. PATENT DOCUMENTS

| | | | | |
|---|---|---|---|---|
| 3,856,989 | A * | 12/1974 | Weimer | 348/318 |
| 5,444,391 | A * | 8/1995 | Moitie et al. | 326/16 |
| 6,201,520 | B1 * | 3/2001 | Iketsu et al. | 345/76 |
| 7,808,456 | B2 * | 10/2010 | Chen et al. | 345/76 |
| 7,834,824 | B2 * | 11/2010 | Routley et al. | 345/77 |
| 8,026,871 | B2 * | 9/2011 | Gunner et al. | 345/76 |
| 2001/0024186 | A1 * | 9/2001 | Kane et al. | 345/98 |
| 2002/0167471 | A1 * | 11/2002 | Everitt | 345/76 |
| 2003/0156101 | A1 * | 8/2003 | LeChevalier | 345/204 |

FOREIGN PATENT DOCUMENTS

| | | |
|---|---|---|
| JP | 2004-246117 | 9/2004 |
| KR | 1020040096186 | 11/2004 |
| KR | 1020070040436 | 4/2007 |

OTHER PUBLICATIONS

English Abstract for JP Pat. Pub. No. 2004-246117, 1 page.
English Abstract for KR Pat. Pub. No. 1020070040436, 1 page.
English Abstract for KR Pat. Pub. No. 1020040096186, 1 page.

* cited by examiner

*Primary Examiner* — Tung X Le
(74) *Attorney, Agent, or Firm* — Innovation Counsel LLP

(57) ABSTRACT

To drive light-emitting blocks, currents are sensed through the light-emitting blocks arranged in an M×N matrix (wherein M and N are natural numbers), wherein M rows are connected to a row switching part and N columns are connected to a column switching part. The light-emitting blocks are driven by a local dimming method with feedback control responsive to the sensed currents.

22 Claims, 7 Drawing Sheets

FEEDBACK CONTROL OF LIGHTING-EMITTING BLOCKS IN A DISPLAY APPARATUS

PRIORITY STATEMENT

This application claims priority under 35 U.S.C. §119 to South Korean Patent Application No. 2008-51810, filed on Jun. 2, 2008 in the Korean Intellectual Property Office (KIPO), the contents of which are herein incorporated by reference in their entirety.

BACKGROUND OF THE INVENTION

1. Field of the Invention

The present invention relates to light emitting blocks such as can be used to provide light to a display device, e.g. a liquid crystal display.

2. Description of the Related Art

Liquid crystal displays (LCDs) are a type of flat panel displays. The LCDs are popular for being thin, light, having a low driving voltage and low power consumption, and for other advantages as compared to other types of displays such as cathode ray tube (CRT), plasma display panel (PDP), and others. In particular, the LCDs are widely employed in electronic devices such as monitors, laptop computers, cellular phones, television sets, etc. An LCD includes an LCD panel that displays images by setting the light-transmitting ratio of liquid crystal molecules, and also includes a backlight assembly disposed below the LCD panel to provide the LCD panel with light.

The LCD panel includes an array substrate, another substrate opposite to the array substrate, and a liquid crystal layer between the two substrates. The array substrate includes signal lines, thin-film transistors (TFTs) and pixel electrodes. The substrate opposite to the array substrate contains a common electrode.

The backlight assembly may employ cold cathode fluorescent lamps (CCFLs) as a light source. Presently it is common for the backlight assembly to employ light-emitting diodes (LEDs) having low power consumption and high color reproducibility.

The backlight assembly may generate light by using individually controlled light-emitting blocks arranged in a matrix so as to enhance the contrast ratio and decrease power consumption. Each light-emitting block may have a number of LEDs.

In order to individually control the light emitting blocks, the backlight assembly may include a plurality of row switches for individually controlling each row of the light-emitting blocks and a plurality of column switches for individually controlling each column of the light-emitting blocks. The row and column switches allow individual control of each light-emitting block. However, additional control is desired over the luminance level of the emitted light.

SUMMARY

This section summarizes some features of some embodiments of the present invention. These features are not limiting.

Some embodiments of the present invention provide improved control over the luminance of light emitted by a display device, e.g. by a backlight assembly of a liquid crystal display.

Some embodiments provide a method of driving light-emitting blocks, the method comprising: sensing currents through a plurality of light-emitting blocks arranged in an M×N matrix (wherein M and N are natural numbers), wherein M rows are connected to a row switching part and N columns are connected to a column switching part; and driving the light-emitting blocks by a local dimming method with feedback control responsive to the sensed currents.

In some embodiments, the sensing of the currents and the driving of the light-emitting blocks are performed within one frame interval.

In some embodiments, the sensing of the currents occupies about 5% to about 10% of the one frame interval.

In some embodiments, the sensing of the currents is performed once in every K frames wherein K is a natural number.

In some embodiments, the sensing of the currents is performed during one frame interval during which the driving of the light-emitting blocks is not performed.

In some embodiments, the sensing of the currents is performed once in every 60 to 120 frames.

In some embodiments, the sensing the currents comprises an operation (a) or an operation (b). The operation (a) comprises: (a1) sequentially (one row after another) driving the M rows of the light-emitting blocks; and (a2) while each of the M rows of the light-emitting blocks is being driven, sequentially (one column after another) driving the N columns of the light-emitting blocks. The operation (b) comprises: (b1) sequentially (one column after another) driving the N columns of the light-emitting blocks; and (b2) while each of the N columns of the light-emitting blocks is being driven, sequentially (one row after another) driving the M rows of the light-emitting blocks. The method further comprises sequentially (one light-emitting block after another) sensing the currents through each of the light-emitting blocks.

In some embodiments, the sensing the currents comprises an operation (a) or an operation (b). The operation (a) comprises: (a1) sequentially (one row after another) driving the M rows of the light-emitting blocks; (a2) while each of the M rows of the light-emitting blocks is being driven, driving all the N columns of the light-emitting blocks so that driving of different columns overlaps in time; and (a3) for each the row of the light emitting blocks, while the row is being driven, sensing the currents through the row's light-emitting blocks so that sensing the currents in different columns overlaps in time. The operation (b) comprises: (b1) sequentially (one column after another) driving the N columns of the light-emitting blocks; (b2) while each of the N columns of the light-emitting blocks is being driven, driving all the M rows of the light-emitting blocks so that driving of different rows overlaps in time; and (b3) for each the column of the light emitting blocks, while the column is being driven, sensing the currents through the column's light-emitting blocks so that sensing the currents in different rows overlaps in time.

Some embodiments provide a backlight assembly comprising: a light-emitting substrate comprising a plurality of light-emitting blocks that are arranged in an M×N matrix (wherein M and N are natural numbers); a switching device comprising (i) a row switching part electrically connected to each of M rows of the light-emitting blocks, (ii) a column switching part electrically connected to each of N columns of the light-emitting blocks, and (iii) a current-sensing part for sensing currents through the light-emitting blocks to generate a feedback signal; a light-emitting control device for providing the switching device with a light-emitting control signal controlling the row and column switching parts to drive the light-emitting blocks by a local dimming method with feedback control responsive to the feedback signal.

In some embodiments, the row switching part comprises M row switching transistors electrically connected to the respective M rows of the light-emitting blocks, and the column switching part comprises N column switching transistors electrically connected to the respective N columns of the light-emitting blocks.

In some embodiments, the light-emitting control signal comprises M row switching signals for controlling the respective M row switching transistors, and comprises N column switching signals for controlling the respective N column switching transistors.

In some embodiments, the current-sensing part is electrically connected to the row switching transistors or the column switching transistors to sense currents through the light-emitting blocks.

In some embodiments, the current-sensing part comprises one or more current sensing resistors electrically connected to the row switching transistors or the column switching transistors to sense currents through the light-emitting blocks.

In some embodiments, the one or more current sensing resistors comprise N current sensing resistors electrically connected to the respective N column switching transistors, or comprise M current sensing resistors electrically connected to the respective M row switching transistors.

In some embodiments, the currents-sensing part further comprises one or more signal converters for converting the currents sensed by the one or more current sensing resistors into the feedback signal.

Some embodiments comprise a power supply device for generating a driving voltage for driving the light-emitting blocks.

In some embodiments, the power supply device is electrically connected to the switching device to provide the light-emitting blocks with the driving voltage through the switching device.

In some embodiments, each of the light-emitting blocks comprises at least one light-emitting diode (LED).

Some embodiments provide a display apparatus comprising a display unit for displaying images using a source of light; and a backlight assembly serving as the source of light, wherein the backlight assembly comprises: a light-emitting substrate comprising a plurality of light-emitting blocks that are arranged in an M×N matrix (wherein M and N are natural numbers); a switching device comprising (i) a row switching part electrically connected to each of M rows of the light-emitting blocks, (ii) a column switching part electrically connected to each of N columns of the light-emitting blocks, and (iii) a current-sensing part for sensing currents through the light-emitting blocks to generate a feedback signal; and a light-emitting control device for providing the switching device with a light-emitting control signal controlling the row and column switching parts to drive the light-emitting blocks by a local dimming method with feedback control responsive to the feedback signal.

In some embodiments, the light-emitting control device is for providing the switching device with the light-emitting control signal in response to an image signal received from an external device and is for providing the display unit with an image control signal for displaying an image.

In some embodiments, the row switching part comprises M row switching transistors electrically connected to the respective M rows of the light-emitting blocks, the column switching part comprises N column switching transistors electrically connected to the respective N columns of the light-emitting blocks, and the light-emitting control signal comprises M row switching signals for controlling the respective M row switching transistors, and comprises N column switching signals for controlling the respective N column switching transistors.

In some embodiments, the current-sensing part comprises: one or more current sensing resistors electrically connected to the column switching transistors or the row switching transistors to sense currents through the light-emitting blocks; and a signal converter for converting the currents sensed by the one or more current sensing resistors into the feedback signal.

According to some embodiments of the present invention, currents applied to the light-emitting blocks are sensed and the light-emitting blocks are feedback-controlled through the sensed currents, to provide improved control over the luminance of light emitted by the light-emitting blocks.

DESCRIPTION OF SOME EMBODIMENTS

Figure 1:
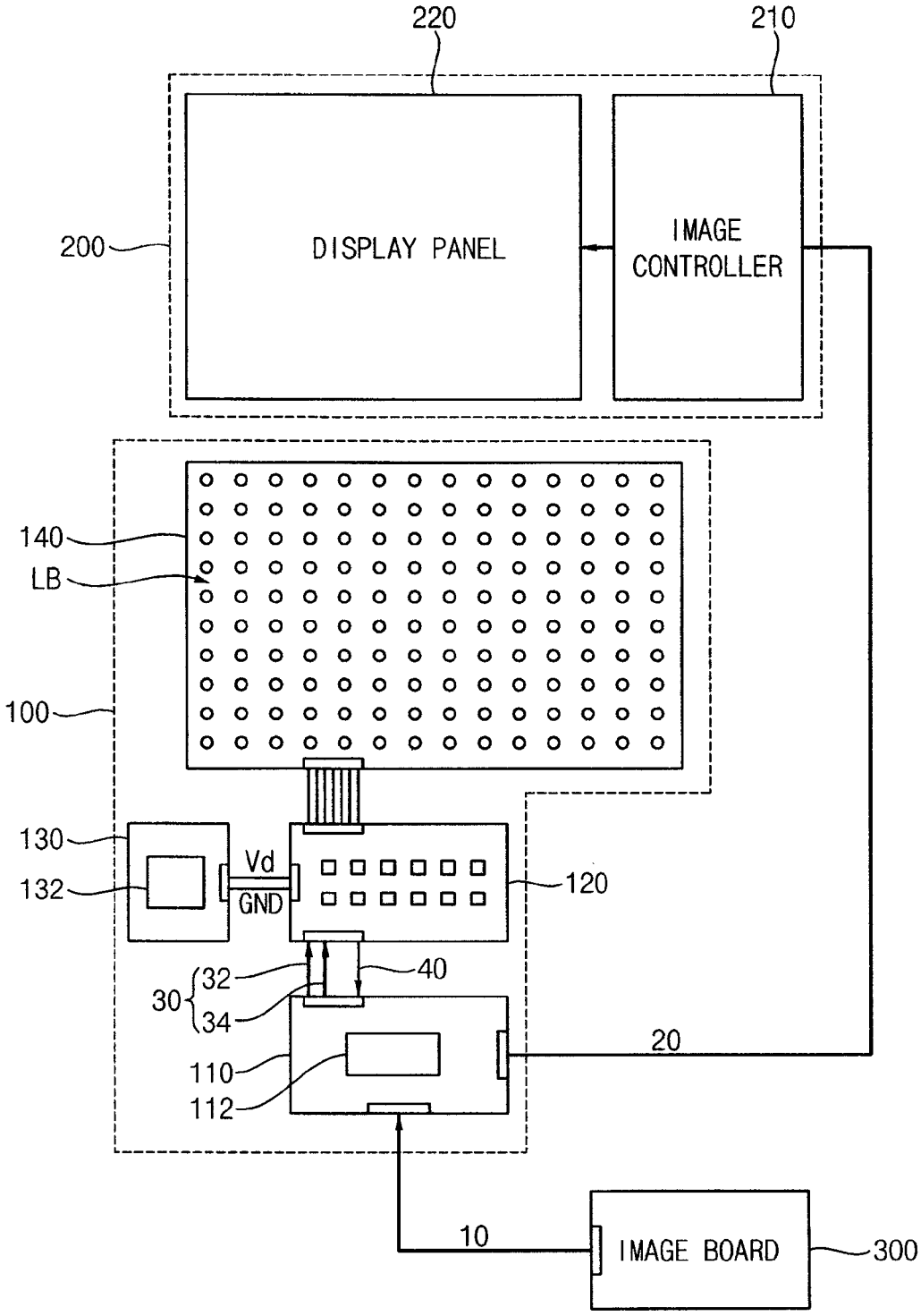
FIG. 1 is a schematic plan view of a display apparatus according to some embodiments of the present invention.

Some embodiments of the present invention are described below with reference to the accompanying drawings. The present invention may, however, be embodied in many different forms and should not be construed as limited to the example embodiments set forth herein. In the drawings, the sizes and relative sizes of layers and regions may be exaggerated for clarity.

It will be understood that the terms like "first", "second", "third" etc. are mere reference labels which do not limit the invention. Thus, a "first" element, component, region, layer or section discussed below could be termed a second element, component, region, layer or section without departing from the teachings of the present invention.

Spatially relative terms, such as "beneath," "below," "lower," "above," "upper" and the like, may be used herein to describe one element or feature's relationship to another element(s) or feature(s) as illustrated in the figures. It will be understood that the spatially relative terms are not limiting and the invention may encompass different orientations of the device in use or operation in addition to the orientation depicted in the figures.

Now some embodiments of the present invention will be explained in detail with reference to the accompanying drawings.

Example Embodiment 1

FIG. 1 is a plan view schematically illustrating a display apparatus according to Embodiment 1 of the present invention. The display apparatus includes a backlight assembly 100 generating light and a display unit 200 using this light to generate images.

The backlight assembly 100 may include a light-emitting control substrate 110, a switching substrate 120, a power supply substrate 130 and a light-emitting substrate 140. The light-emitting substrate 140 may include a plurality of light-emitting blocks LB arranged in a matrix.

The light-emitting control substrate 110 receives an image signal 10 from an external image board 300. The light-emitting control substrate 110 provides the display unit 200 with an image control signal 20 in response to the image signal 10, and provides the switching substrate 120 with a light-emitting control signal 30. The light-emitting control signal 30 may include a row switching signal 32 and a column switching signal 34.

The light-emitting control substrate 110 may include a local dimming control logic 112 which generates the light-emitting control signal 30 for individually controlling the light-emitting blocks LB of the light-emitting substrate 140 in response to the image signal 10.

The switching substrate 120 receives the light-emitting control signal 30 from the light-emitting control substrate 110 to control the light-emitting substrate 140 in response to the light-emitting control signal 30.

The switching substrate 120 senses currents flowing through the light-emitting blocks LB of the light-emitting substrate 140, and convert the sensed currents into a feedback signal 40. The feedback signal 40 is used by the light-emitting control substrate 110 or by the switching substrate 120 itself to individually control the light-emitting blocks LB of the light-emitting substrate 140 to generate light of desired luminance.

The power supply substrate 130 generates a driving voltage Vd and a ground voltage GND for driving the light-emitting blocks LB of the light-emitting substrate 140. The power supply substrate 130 may include a transformer capable of transforming an external voltage from an external device to the driving voltage Vd. For example, the external voltage may be a direct current (DC) voltage of about 24 V, and the driving voltage Vd may be a DC voltage of about 36 V.

The power supply substrate 130 is electrically connected to the switching substrate 120 to provide the switching substrate 120 with the driving voltage Vd and the ground voltage GND. The driving voltage Vd and the ground voltage GND may be transferred to the light-emitting blocks LB of the light-emitting substrate 140 through the switching substrate 120.

The light-emitting blocks LB of the light-emitting substrate 140 receive the driving voltage Vd and the ground voltage GND from the switching substrate 120, and generate light under individual control of the switching substrate 120. In this way, the light-emitting blocks LB of the light-emitting substrate 140 may be driven by the switching substrate 120 using a local dimming method.

The display unit 200 may display images in response to the image control signal 20 applied from the light-emitting control substrate 110. The display unit 200 may include, for example, an image controller 210 and a display panel 220.

The image controller 210 receives the image control signal 20 from the light-emitting substrate 110 and controls the display panel 220 in response to the image control signal 20. In this embodiment, the image controller 210 does not receive the image control signal 20 from the light-emitting control substrate 110 but directly receives the image control signal 20 from the image board 300.

The display panel 220 may use light generated by the backlight assembly 100 to display an image under control of the image controller 210. For example, the display panel 210 may include a first substrate (not shown), a second substrate (not shown) opposite to the first substrate, and a liquid crystal layer (not shown) interposed between the first and second substrates.

The first substrate may include a plurality of signal lines, a plurality of thin-film transistors (TFTs) electrically connected to the respective signal lines, and a plurality of pixel electrodes electrically connected to the respective TFTs. The second substrate may include a plurality of color filters opposite to the pixel electrodes and a common electrode. Alternatively, the color filters may be formed in the first substrate.

Figure 2:
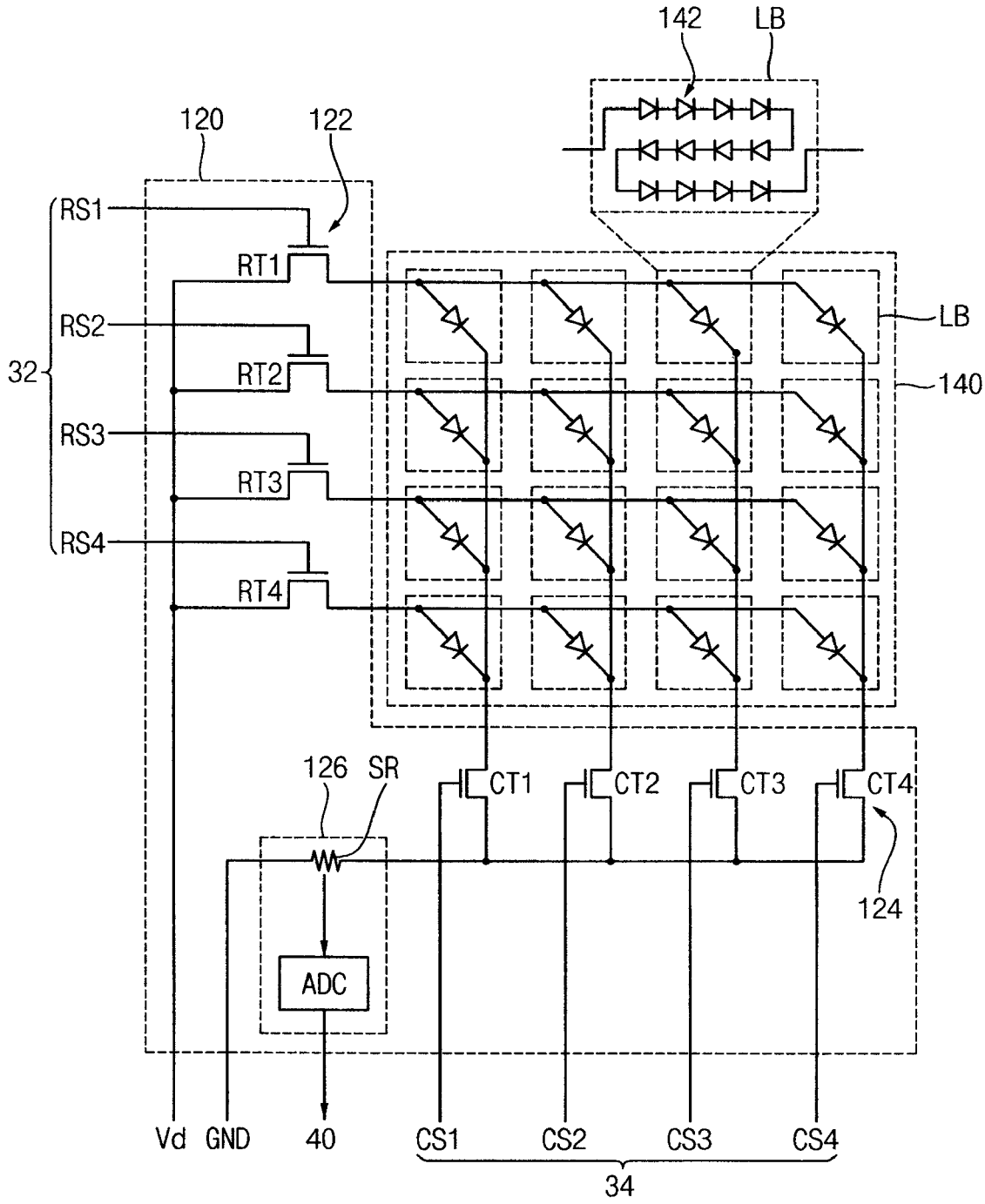
FIG. 2 is a circuit diagram illustrating a light-emitting substrate and a switching substrate in a backlight assembly for a display apparatus according to some embodiments of the present invention.

FIG. 2 is a circuit diagram illustrating one embodiment of the light-emitting substrate and the switching substrate of the backlight assembly 100 of FIG. 1.

Referring to FIGS. 1 and 2, the light-emitting blocks LB of the light-emitting substrate 140 are arranged in an M×N matrix (wherein M and N are natural numbers). For example, the light-emitting blocks LB may be arranged in a 4×4 matrix as illustrated in FIG. 2.

Each of the light-emitting blocks LB may include at least one light-emitting diode (LED) 142, and may include a plurality of serially connected LEDs 142. In one example, each light-emitting block LB includes at least one red LED 142, at least one green LED 142, and at least one blue LED 142. In another example, each light-emitting block LB includes a single LED 142 which is a white LED.

The switching substrate 120 according to the present embodiment includes a row switching part 122, a column switching part 124 and a current-sensing part 126.

The row switching part 122 is electrically connected to each of the M rows of the light-emitting blocks LB. For example, the row switching substrate 122 may include a first row switching transistor RT1, a second row switching transistor RT2, a third row switching transistor RT3 and a fourth row switching transistor RT4 whose output terminals are electrically connected to the respective four rows of the light-emitting blocks LB.

The row switching part 122 receives the driving voltage Vd provided by the power supply substrate 130. For example, the driving voltage Vd may be applied to the input terminals of the first through fourth row switching transistors RT1, RT2, RT3 and RT4.

The row switching part 122 is controlled by the row switching signal 32 received from the light-emitting control substrate 110. The row switching signal 32 may include a first row switching signal RS1, a second row switching signal RS2, a third row switching signal RS3 and a fourth row switching signal RS4 which are applied to the control terminals of the respective first to fourth row switching transistors RT1, RT2, RT3 and RT4.

When any one of the first to fourth row switching signals RS1, RS2, RS3 and RS4 is applied to the control terminal of the respective one of the first to fourth row switching transistors RT1, RT2, RT3 and RT4, the respective row switching transistor RT1, RT2, RT3 or RT4 is turned on. Consequently, the driving voltage Vd received at to the row switching transistor's input terminal is applied to the respective row of the light-emitting blocks LB.

The column switching part 124 is electrically connected to each of the N columns of the light-emitting blocks LB. The column switching part 124 may include a first column switching transistor CT1, a second column switching transistor CT2, a third column switching transistor CT3 and a fourth column switching transistor CT4 whose input terminals are electrically connected to the respective four columns of the light-emitting blocks LB.

The column switching part 124 is controlled by the column signal 34 received from the light-emitting control substrate 110. For example, the column switching signal 34 may include a first column switching signal CS1, a second column switching signal CS2, a third column switching signal CS3 and a fourth column switching signal CS4. The first to fourth column switching signals CS1, CS2, CS3 and CS4 are applied to the control terminals of the respective first to fourth column switching transistors CT1, CT2, CT3 and CT4.

When any one of the first to fourth column switching signals CS1, CS2, CS3 and CS4 is applied to the control terminal of the respective one of the first to fourth column switching transistors CT1, CT2, CT3 and CT4, the respective column switching transistor CT1, CT2, CT3 or CT4 is turned on. Consequently, the current provided by the respective column of the light-emitting blocks LB flows into the input terminal and then into the channel region of the respective column switching transistor CT1, CT2, CT3 or CT4.

The current-sensing part 126 is electrically connected to the output terminals of the first to fourth column switching transistors CT1, CT2, CT3 and CT4 to sense the currents through the light-emitting blocks LB. The current-sensing part 126 uses the sensed currents to generate the feedback signal 40 for the light-emitting control substrate 110. (In the embodiment of FIG. 2, the current-sensing part 126 has a first terminal electrically connected to the output terminals of the first to fourth column switching transistors CT1, CT2, CT3 and CT4, and has a second terminal receiving the ground voltage GND from the power supply substrate 130.)

In the present embodiment, the current-sensing part 126 is electrically connected to output terminals of the first to fourth column switching transistors CT1, CT2, CT3 and CT4. Alternatively, the current-sensing part 126 may be electrically connected to the input terminals of the first to fourth column switching transistors CT1, CT2, CT3 and CT4 and to the four columns of the light-emitting blocks LB. In still other embodiments, the current-sensing part 126 may be electrically connected to the four rows of the light-emitting blocks LB and the output terminals of the first to fourth row switching transistors RT1, RT2, RT3 and RT4. Further in some embodiments, the current-sensing part 126 is electrically connected to the input terminals of the first to fourth row switching transistors RT1, RT2, RT3 and RT4.

In some embodiments, the current-sensing part 126 includes a current sensing resistor SR and a signal converter ADC (e.g. an analog-to-digital converter). A first terminal of the current sensing resistor SR is electrically connected to the output terminals of the first to fourth column switching transistors CT1, CT2, CT3 and CT4. A second terminal of the current sensing resistor SR receives the ground voltage GND from the power supply substrate 130. The current sensing resistor SR may sense current flowing through the light-emitting blocks LB.

The signal converter ADC converts the analog current sensed by the current sensing resistor SR into the digital feedback signal 40.

The current-sensing part 126 senses current flowing through each of the light-emitting blocks LB and generates the feedback signal 40 provided to the light-emitting control substrate 110. In response, the light-emitting control substrate 110 performs feedback control of the switching substrate 120, so that each of the light-emitting blocks LB may be controlled to generate light having a desired luminance.

Now the control of the light-emitting blocks LB will be described in detail.

Figure 3:
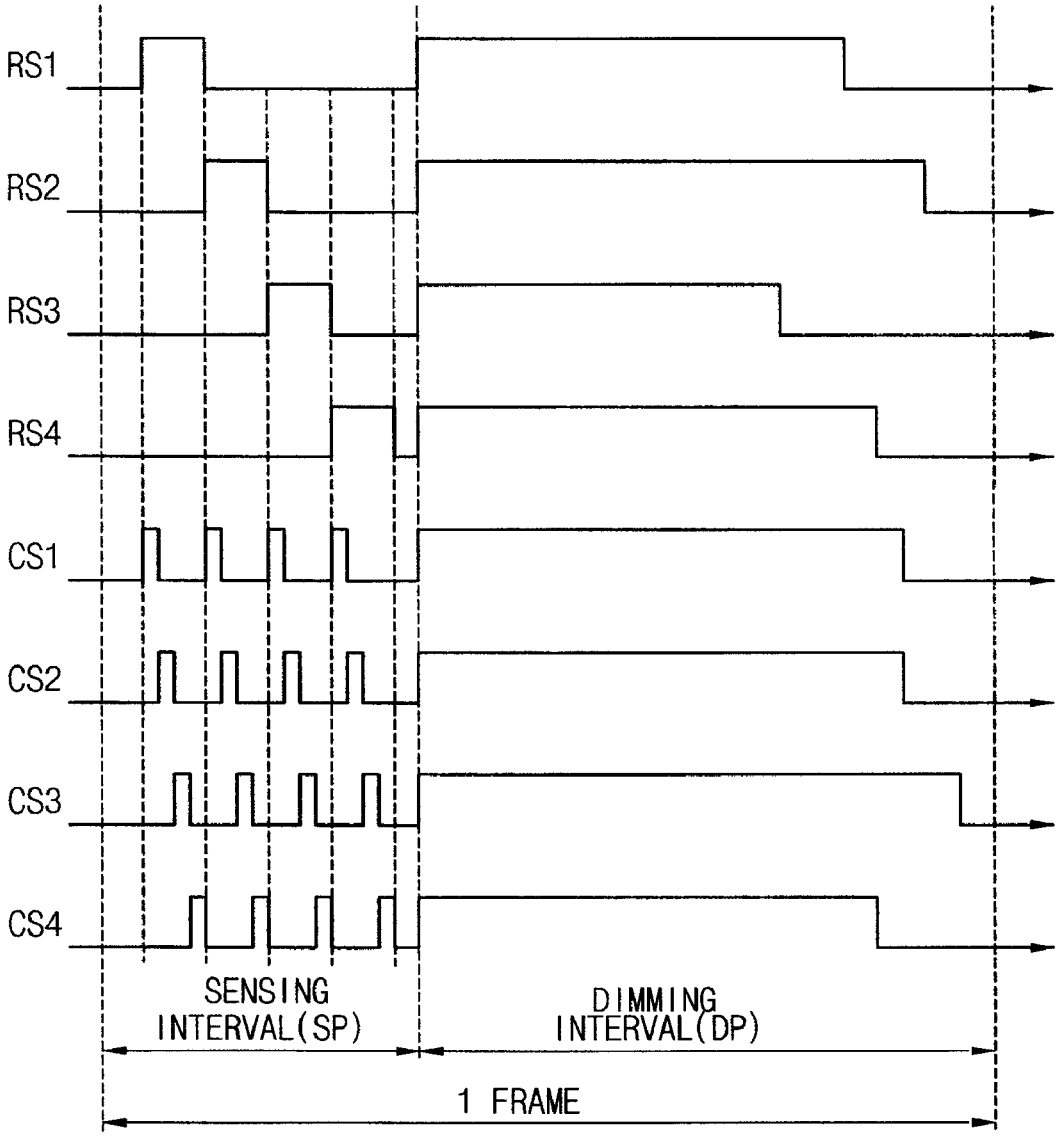
FIG. 3 shows waveform diagrams illustrating row switching signals and column switching signals for the switching substrate of FIG. 2.

FIG. 3 shows timing diagrams for the row and column switching signals in the switching substrate 120 of FIG. 2. During a sensing interval SP, the switching substrate 130 senses current through each of the light-emitting blocks LB. One current-sensing operation is performed on each light-emitting block LB by applying a suitable row switching signal 32 to the row switching part 122 and applying a suitable column switching signal 34 to the column switching part 124.

For example, while a pulse of the first row switching signal RS1 is applied to the first row switching transistor RT1, pulses of the first to fourth column switching signals CS1, CS2, CS3 and CS4 are sequentially applied to the respective first to fourth column switching transistors CT1, CT2, CT3 and CT4, so that the light-emitting blocks LB in the first row sequentially generate light. At this time, currents are sensed in each of the first to fourth columns of the light-emitting blocks LB.

Then, during a pulse of the second row switching signal RS2 applied to the second row switching transistor RT2, pulses of the first to fourth column switching signals CS1, CS2, CS3 and CS4 are sequentially applied to the respective first to fourth column switching transistors CT1, CT2, CT3 and CT4, so that the light-emitting blocks LB in the second row sequentially generate light. At this time, currents are sensed in each of the first to fourth columns of the light-emitting blocks LB.

Then, during a pulse of the third row switching signal RS3 applied to the third row switching transistor RT3, pulses of the first to fourth column switching signals CS1, CS2, CS3 and CS4 are sequentially applied to the respective first to fourth column switching transistors CT1, CT2, CT3 and CT4, so that the light-emitting blocks LB in the third row sequentially generate light. At this time, currents are sensed in each of the first to fourth columns of the light-emitting blocks LB.

Then, during a pulse of the fourth row switching signal RS4 applied to the fourth row switching transistor RT4, pulses of the first to fourth column switching signals CS1, CS2, CS3 and CS4 are sequentially applied to the respective first to fourth column switching transistors CT1, CT2, CT3 and CT4, so that the light-emitting blocks LB of the fourth row sequentially generate light. At this time, currents are sensed in each of the first to fourth columns of the light-emitting blocks LB.

As described above, pulses of the first to fourth row switching signals RS1, RS2, RS3 and RS4 are sequentially applied to the row switching part 122, and during each such pulse, the first to fourth column switching signals CS1, CS2, CS3 and CS4 are sequentially applied to the column switching part 124. In this manner, current can be sensed in each of the light-emitting blocks LB.

In other embodiments, the row and column sensing are interchanged. More particularly, pulses of the first to fourth column switching signals CS1, CS2, CS3 and CS4 are sequentially applied to the column switching part 124, and during each such column pulse, pulses of the first to fourth row switching signals RS1, RS2, RS3 and RS4 are sequentially applied to the row switching part 122, so that currents can be sensed in each of the light-emitting blocks LB.

Then, during a dimming interval DP, the light-emitting blocks LB are individually driven by a local dimming method based on a feedback control responsive to the sensed currents. Thus, the sensed currents are used to control the light-emitting blocks during the dimming interval DP to generate light having a desired luminance.

For example, when the sensed current in any one of the light-emitting blocks LB is lower than a target current value, the current in the light-emitting blocks LB may be increased during the dimming interval DP. For example, the current can be increased by increasing the pulse width and/or amplitude of the corresponding row switching signal 32 and/or the corresponding column switching signal 34.

The sensing interval SP and the dimming interval DP may be part of a single frame as illustrated in FIG. 3. For example, the sensing interval SP may take from about 5% to about 10% of the frame, and the dimming interval DP may take the rest of the frame (i.e. about 90-95% of the frame).

The portion of the frame occupied by the sensing interval SP may depend on the number of the light-emitting blocks LB, the minimum durations of the first to fourth row switching signals RS1, RS2, RS3 and RS4 and the first to fourth column switching signals CS1, CS2, CS3 and CS4, and the minimum time needed for the signal converter ADC. The minimum time needed for the signal converter ADC is the minimum width of the analog signal required by the converter ADC for conversion to the digital form.

For example, an increase in the number of the light-emitting blocks LB, or in the minimum duration of each row switching signal RS1, RS2, RS3 and RS4 or each column switching signal CS1, CS2, CS3 and CS4, or in the minimum time needed for the signal converter ADC, may require increasing the frame portion allocated for the sensing interval SP.

Figure 4:
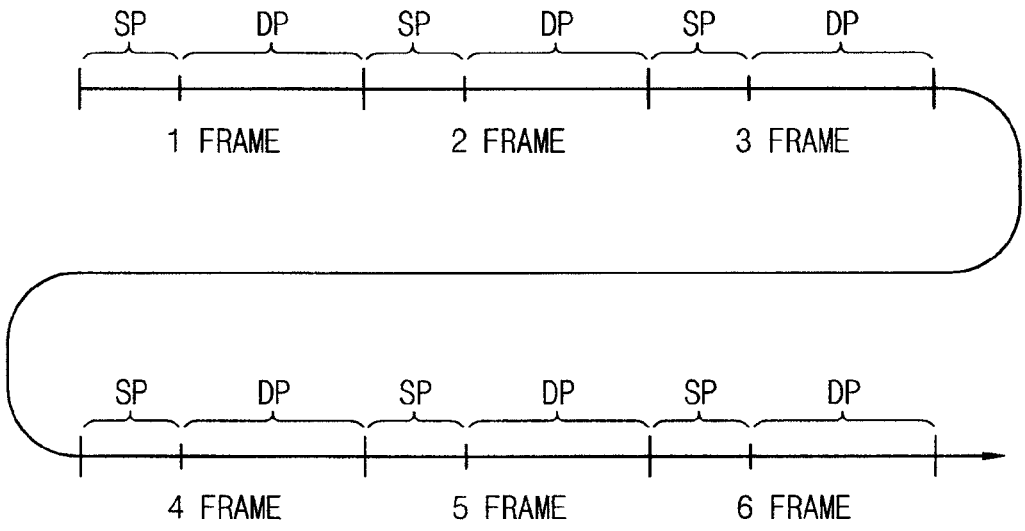
FIG. 4 is a schematic diagram illustrating an embodiment in which a sensing interval of FIG. 3 is repeated in each frame.

FIG. 4 is a schematic diagram illustrating an embodiment in which one sensing operation (the operation performed in a single sensing interval SP) is performed in each frame. Each frame contains a single sensing interval SP and a single dimming interval DP.

Figure 5:
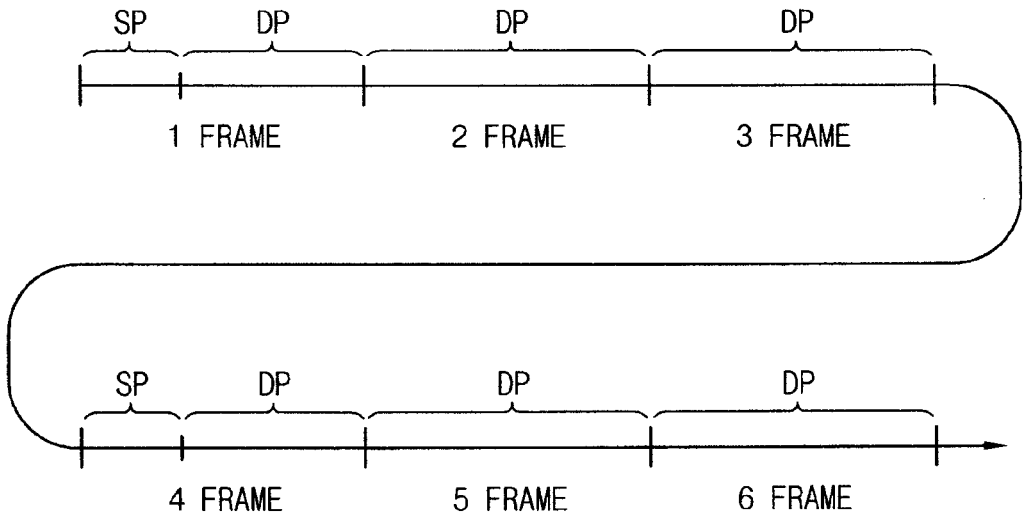
FIG. 5 is a schematic diagram illustrating an embodiment in which the sensing interval of FIG. 3 is repeated every predetermined number K of frames where K is greater than or equal to 2.

FIG. 5 is a schematic diagram illustrating an embodiment in which the sensing operation of FIG. 3 is repeated every predetermined number K of frames where K is at least 2. For example, a sensing interval SP may occur once in every two frames, or once in every three frames as in FIG. 5, or once in some other number of frames.

In some embodiments, the display apparatus is driven at a frame refresh rate of 60 Hz, and the sensing interval SP occurs once per 60 frames. In some embodiments, the display apparatus is driven at a frame refresh rate of 120 Hz, and the sensing interval SP occurs once per 120 frames.

Figure 6:
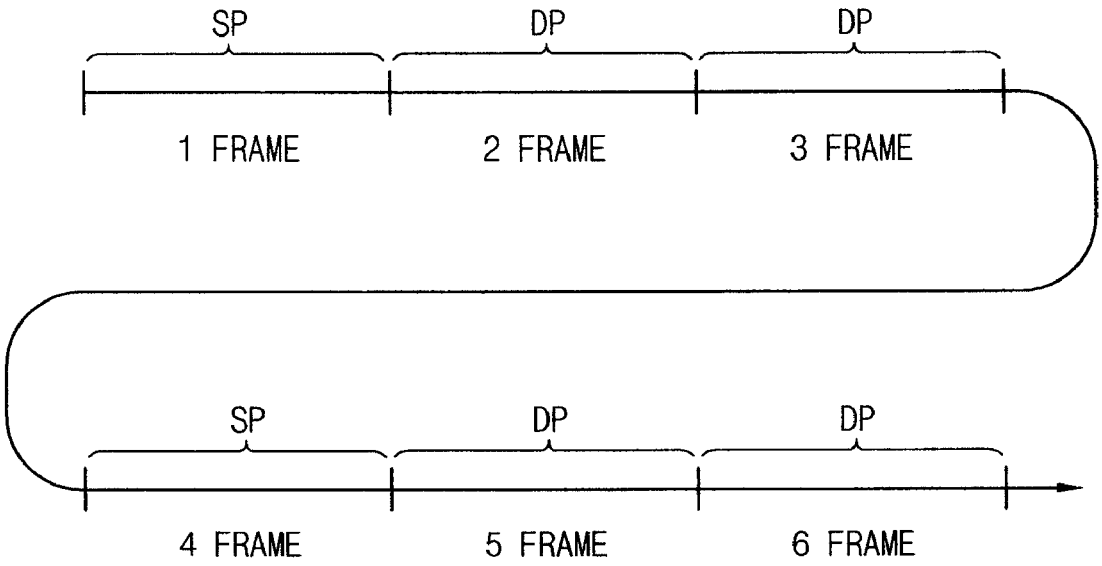
FIG. 6 is a schematic diagram illustrating an embodiment in which the sensing interval of FIG. 3 is performed during a separate frame not containing a dimming interval, and is repeated every predetermined number of frames.

FIG. 6 is a schematic diagram illustrating an embodiment in which a sensing interval of FIG. 3 is given an entire frame and is repeated every predetermined number of frames (once per at least two frames). For example, the sensing interval SP may occur once per three frames as illustrated in FIG. 6.

In some embodiments, the display apparatus is driven at a frame refresh rate of 60 Hz, and the sensing interval SP is performed once per 60 frames. In some embodiments, the display apparatus is driven at a frame refresh rate of 120 Hz, and the sensing interval SP is performed once per 120 frames.

Thus, according to the present embodiment, before the light-emitting blocks LB are driven by a local dimming method, a current is provided to each light-emitting block LB and is pre-sensed and used for feedback control of the light-emitting block LB to provide a desired luminance. The image display quality may therefore be enhanced.

Example Embodiment 2

Figure 7:
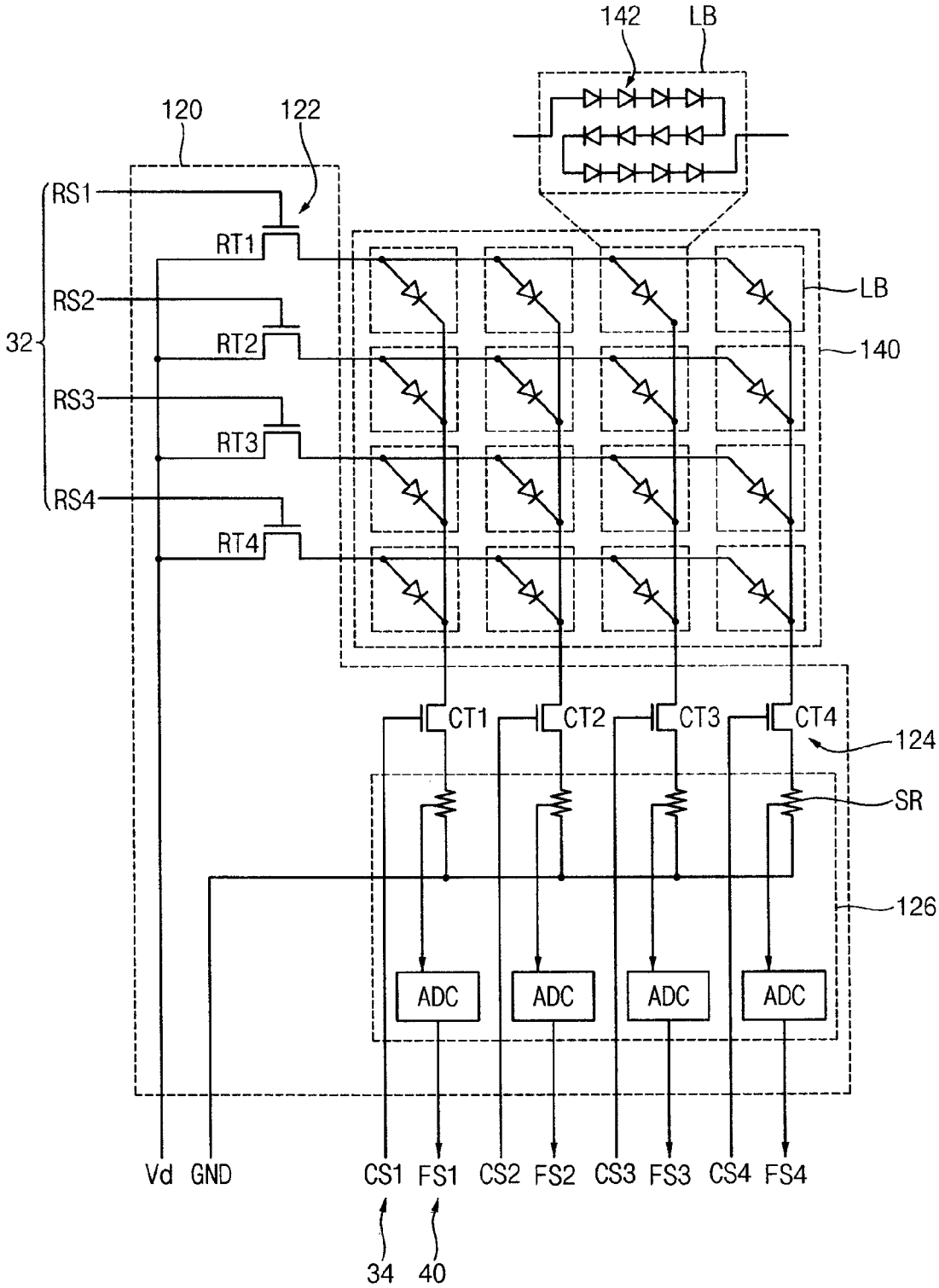
FIG. 7 is a circuit diagram illustrating a light-emitting substrate and a switching substrate of a backlight assembly of a display apparatus according to some embodiments of the present invention.

FIG. 7 is a circuit diagram illustrating a light-emitting substrate and a switching substrate of a backlight assembly of a display apparatus according to Embodiment 2 of the present invention. The display apparatus is substantially identical to the display apparatus according to Embodiment 1 as illustrated in FIGS. 1 and 2, except for the current-sensing part 126 of the switching substrate 120. Identical reference numerals are used in FIG. 7 to refer to the same components as shown in FIGS. 1 and 2, and a detailed description of such components will be omitted.

Referring to FIGS. 1 and 7, the current-sensing part 126 is electrically connected to the output terminals of the first to fourth column switching transistors CT1, CT2, CT3 and CT4 to sense currents through the light-emitting blocks LB. From the sensed currents, the current-sensing part 126 generates the feedback signal 40 provided to the light-emitting control substrate 110.

The current-sensing part 126 includes first to fourth current sensing resistors ("sensing resistors") SR coupled to respective first to fourth signal converters (analog-to-digital converters) ADC and to the respective first to fourth column switching transistors CT1, CT2, CT3 and CT4.

First terminals of the first to fourth sensing resistors are electrically connected to the output terminals of the respective first to fourth column switching transistors CT1, CT2, CT3 and CT4. The ground voltage GND from the power supply substrate 130 is applied to second terminals of the first to fourth sensing resistors. The first to fourth sensing resistors may sense currents flowing through the respective columns of the light-emitting blocks LB.

Each signal converter ADC converts the current sensed by the corresponding sensing resistor into a respective feedback signal FS1 ("first feedback signal"), FS2 ("second feedback signal"), FS3 ("third feedback signal") or FS4 ("fourth feedback signal"). These feedback signals form the feedback signal 40. The sensed currents may be in analog form, and the feedback signals FS1, FS2, FS3 and FS4 may be in digital form.

In the present embodiment, the current-sensing part 126 is electrically connected to the output terminals of the first to fourth column switching transistors CT1, CT2, CT3 and CT4. Alternatively, the current-sensing part 126 may be electrically connected to the input terminals of the first to fourth column switching transistors CT1, CT2, CT3 and CT4 and the four columns of the light-emitting blocks LB. In another alternative, the current-sensing part 126 may be electrically connected to the four rows of the light-emitting blocks LB and the output terminals of the first to fourth row switching transistors RT1, RT2, RT3 and RT4. In still another alternative, the current-sensing part 126 may be electrically connected to the input terminals of the first to fourth row switching transistors RT1, RT2, RT3 and RT4.

Now a method of driving the light-emitting blocks LB of FIG. 7 will be described in detail.

Figure 8:
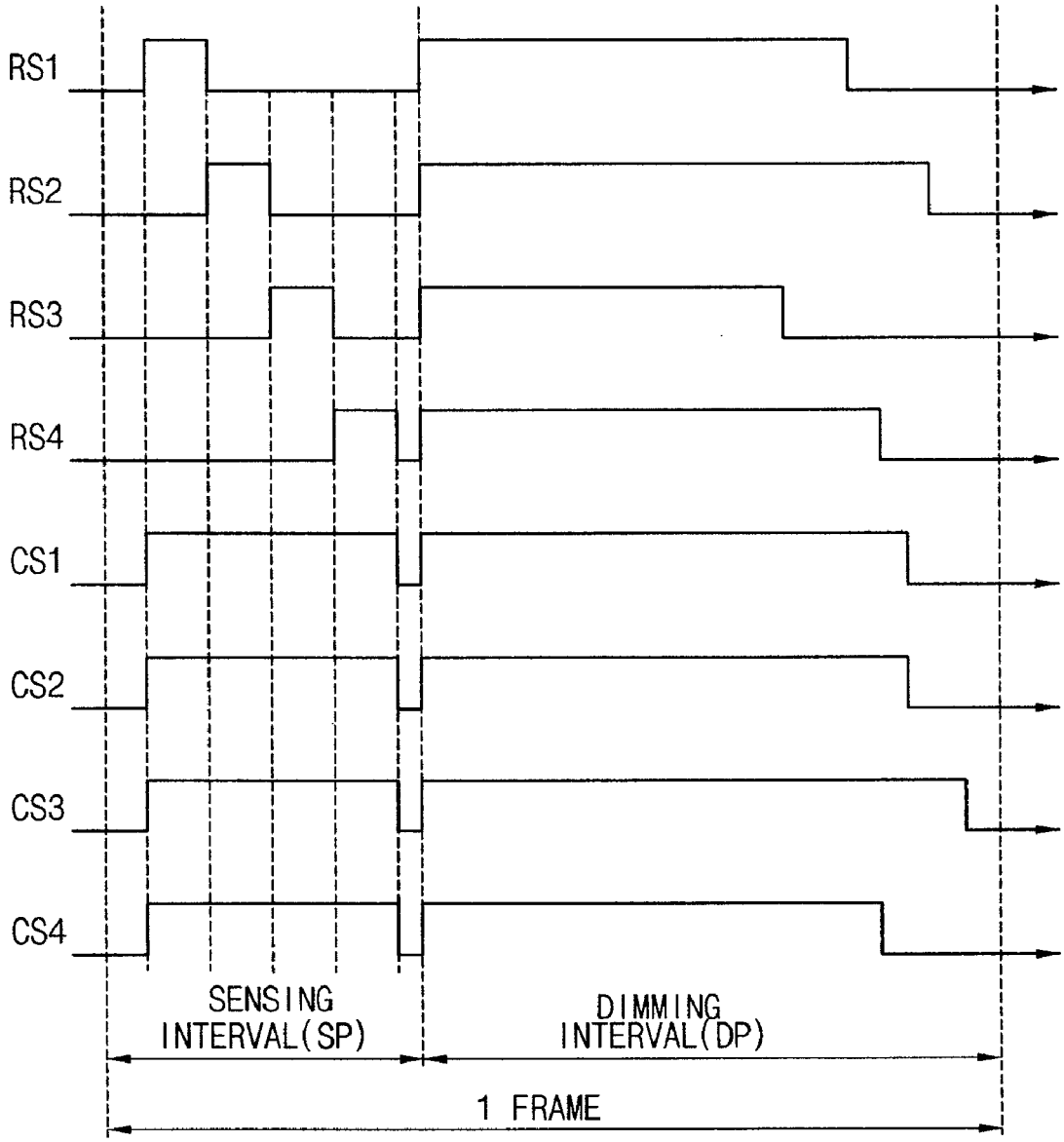
FIG. 8 shows waveform diagrams illustrating row switching signals and column switching signals for the switching substrate of FIG. 7.

FIG. 8 illustrates timing diagrams for the row switching signals and the column switching signals in the switching substrate of FIG. 7. During the sensing interval SP, currents are sensed through each of the light-emitting blocks LB arranged in a 4×4 matrix. The light-emitting blocks LB are activated sequentially via the row switching signal 32 provided to the row switching part 122 and the column switching signal 34 provided to the column switching part 124. When a light-emitting block LB is activated, the current is sensed through the block.

In FIG. 8, the first to fourth column switching signals CS1, CS2, CS3 and CS4 are simultaneously applied to the first to fourth column switching transistors CT1, CT2, CT3 and CT4, respectively, in the sensing interval SP, so that the first to fourth column switching transistors CT1, CT2, CT3 and CT4 are simultaneously turned on. At the same time, the first to fourth row switching signals RS1, RS2, RS3 and RS4 are sequentially applied to the first to fourth row switching transistors RT1, RT2, RT3 and RT4, respectively. Thus, in each column, the light-emitting blocks LB are sequentially activated, and their currents are sequentially sensed in each column.

In an alternative embodiment, the current-sensing part 126 is connected to the input or output terminals of the row switching transistors RT1, RT2, RT3, RT4. The first to fourth row switching signals RS1, RS2, RS3 and RS4 are simultaneously applied to the first to fourth row switching transistors RT1, RT2, RT3 and RT4, respectively, in the sensing interval SP, and the first to fourth column switching signals CS1, CS2, CS3 and CS4 are sequentially applied to the first to fourth column switching transistors CT1, CT2, CT3 and CT4 during the sensing interval SP. Thus, in each row, the light-emitting blocks LB are sequentially activated, and their currents are sequentially sensed in each row.

Then, during the dimming interval DP, the light-emitting blocks LB are individually driven by a local dimming method using a feedback control based on the sensed currents. Thus, the light-emitting blocks may be feedback-controlled to generate light of a desired luminance.

The sensing interval SP and the dimming interval DP may be performed within one frame as illustrated in FIG. 3. The sensing interval SP may be performed once per K frames, wherein K is a natural number greater than one.

Alternatively, the sensing interval SP may be given an entire frame, and be performed once per at least two frames.

According to the present embodiment, since an entire row or column of the light-emitting blocks LB is sensed simultaneously, the duration of the sensing interval may be decreased compared to the embodiment of FIG. 3. Therefore, the duration of the dimming interval DP may be increased.

According to some embodiments of the present invention, currents through light-emitting blocks arranged in a matrix are sensed and the light-emitting blocks are feedback-controlled using the sensed currents, to improve control over the luminance emitted by the light-emitting blocks.

The embodiments described above are illustrative but not limiting.

What is claimed is:

1. A method of driving light-emitting blocks of an image display system, wherein the light-emitting blocks are arranged in an M×N matrix, where each of M and N is a natural number greater than 1, the method comprising:

during a sensing interval, selectively switching on the light-emitting blocks of the M×N matrix so as to sense respective currents then passing through the selectively switched on ones of the light-emitting blocks arranged in the M×N matrix, wherein the matrix has M rows that are connected to a row switching part configured to switch on one or more of the M rows and N columns connected to a column switching part configured to switch on one or more of the N columns; and during a dimming interval, switching on the light-emitting blocks of the M×N matrix so as to thereby drive the light-emitting blocks by a local dimming method, where the local dimming method uses a feedback control that is responsive to the sensed currents.

2. The method of claim 1, wherein the sensing of the currents and the driving of the light-emitting blocks are performed within one frame interval.

3. The method of claim 2, wherein the sensing of the currents occupies about 5% to about 10% of the one frame interval.

4. The method of claim 2, wherein the sensing of the currents is performed once in every K frames wherein K is a natural number.

5. The method of claim 1, wherein the sensing of the currents is performed during one frame interval during which the driving of the light-emitting blocks is not performed.

6. The method of claim 5, wherein the sensing of the currents is performed once in every 60 to 120 frames.

7. The method of claim 1, wherein the sensing the currents comprises an operation (a) or an operation (b), wherein the operation (a) comprises:

(a1) sequentially (one row after another) driving the M rows of the light-emitting blocks; and (a2) while each of the M rows of the light-emitting blocks is being driven, sequentially (one column after another) driving the N columns of the light-emitting blocks;

wherein the operation (b) comprises:

(b1) sequentially (one column after another) driving the N columns of the light-emitting blocks; and (b2) while each of the N columns of the light-emitting blocks is being driven, sequentially (one row after another) driving the M rows of the light-emitting blocks;

wherein the method further comprises sequentially (one light-emitting block after another) sensing the currents through each of the light-emitting blocks.

8. The method of claim 1, wherein the sensing the currents comprises an operation (a) or an operation (b), wherein the operation (a) comprises:

(a1) sequentially (one row after another) driving the M rows of the light-emitting blocks;

(a2) while each of the M rows of the light-emitting blocks is being driven, driving all the N columns of the light-emitting blocks so that driving of different columns overlaps in time; and (a3) for each the row of the light emitting blocks, while the row is being driven, sensing the currents through the row's light-emitting blocks so that sensing the currents in different columns overlaps in time;

wherein the operation (b) comprises:

(b1) sequentially (one column after another) driving the N columns of the light-emitting blocks;

(b2) while each of the N columns of the light-emitting blocks is being driven, driving all the M rows of the light-emitting blocks so that driving of different rows overlaps in time; and (b3) for each the column of the light emitting blocks, while the column is being driven, sensing the currents through the column's light-emitting blocks so that sensing the currents in different rows overlaps in time.

9. A backlight assembly for use in an image display system that uses a backlighting source, where the backlight assembly is capable of operating in a local dimming mode, the backlight assembly comprising:

a light-emitting substrate comprising a plurality of light-emitting blocks that are arranged in an M×N matrix, where M and N are natural numbers each greater than 1;

a switching device comprising (i) a row switching part electrically connected to each of M rows of the light-emitting blocks and operative to selectively switch on one or more of the M rows, (ii) a column switching part electrically connected to each of N columns of the light-emitting blocks and operative to selectively switch on one or more of the N columns, and (iii) at least one current-sensing part disposed in a drive current path of at least a subset of the light-emitting blocks for sensing currents through the at least a subset of the light-emitting blocks for thereby generating feedback signals indicative of the sensed currents;

a light-emitting control device for providing the switching device with a light-emitting control signal controlling the row and column switching parts to drive the light-emitting blocks by a local dimming method that is responsive to the feedback signals.

10. The backlight assembly of claim 9, wherein the row switching part comprises M row switching transistors electrically connected to the respective M rows of the light-emitting blocks, and the column switching part comprises N column switching transistors electrically connected to the respective N columns of the light-emitting blocks.

11. The backlight assembly of claim 10, wherein the light-emitting control signal comprises M row switching signals for controlling the respective M row switching transistors, and comprises N column switching signals for controlling the respective N column switching transistors.

12. The backlight assembly of claim 10, wherein the current-sensing part is electrically connected to the row switching transistors or the column switching transistors to sense currents through the light-emitting blocks.

13. The backlight assembly of claim 12, wherein the current-sensing part comprises one or more current sensing resistors electrically connected to the row switching transistors or the column switching transistors to sense currents through the light-emitting blocks.

14. The backlight assembly of claim 13, wherein the one or more current sensing resistors comprise N current sensing resistors electrically connected to the respective N column switching transistors, or comprise M current sensing resistors electrically connected to the respective M row switching transistors.

15. The backlight assembly of claim 13, wherein the currents-sensing part further comprises one or more signal converters for converting the currents sensed by the one or more current sensing resistors into the feedback signal.

16. The backlight assembly of claim 9, further comprising:

a power supply device for generating a driving voltage for driving the light-emitting blocks.

17. The backlight assembly of claim 16, wherein the power supply device is electrically connected to the switching device to provide the light-emitting blocks with the driving voltage through the switching device.

18. The backlight assembly of claim 9, wherein each of the light-emitting blocks comprises at least one light-emitting diode (LED).

19. A display apparatus comprising:

a display unit configured for displaying images using a source of light; and a backlight assembly configured to serve as the source of light, wherein the backlight assembly comprises:

a light-emitting substrate comprising a plurality of light-emitting blocks that are arranged in an M×N matrix, where M and N are natural numbers each greater than 1;

a switching device comprising (i) a row switching part electrically connected to each of M rows of the light-emitting blocks and operative to selectively switch on one or more of the M rows, (ii) a column switching part electrically connected to each of N columns of the light-emitting blocks and operative to selectively switch on one or more of the N columns, and (iii) at least one current-sensing part disposed in a drive current path of at least a subset of the light-emitting blocks for sensing currents through the at least a subset of the light-emitting blocks for thereby generating feedback signals indicative of the sensed currents;

a light-emitting control device for providing the switching device with a light-emitting control signal controlling the row and column switching parts to drive the light-emitting blocks by a local dimming method that is responsive to the feedback signals.

20. The display apparatus of claim 19, wherein the light-emitting control device is for providing the switching device with the light-emitting control signal in response to an image signal received from an external device and is for providing the display unit with an image control signal for displaying an image.

21. The display apparatus of claim 19, wherein:

the row switching part comprises M row switching transistors electrically connected to the respective M rows of the light-emitting blocks, the column switching part comprises N column switching transistors electrically connected to the respective N columns of the light-emitting blocks, and the light-emitting control signal comprises M row switching signals for controlling the respective M row switching transistors, and comprises N column switching signals for controlling the respective N column switching transistors.

22. The display apparatus of claim 19, wherein the current-sensing part comprises:

one or more current sensing resistors electrically connected to the column switching transistors or the row switching transistors to sense currents through the light-emitting blocks; and a signal converter for converting the currents sensed by the one or more current sensing resistors into the feedback signal.

* * * * *